US005762277A

United States Patent [19]

Uedinger et al.

[11] Patent Number: 5,762,277

[45] Date of Patent: Jun. 9, 1998

[54] TRAVERSE MECHANISM FOR YARN GUIDES OF A WINDING DEVICE

[75] Inventors: Lothar Uedinger, Mönchengladbach; Axel Hellmig, Aachen, both of Germany

[73] Assignee: W. Schlafhorst AG & Co., Moenchengladbach, Germany

[21] Appl. No.: 720,684

[22] Filed: Oct. 2, 1996

[30] Foreign Application Priority Data

Oct. 2, 1995 [DE] Germany ..... 195 36 761.8

[51] Int. Cl.[6] ..... B65H 57/28; B65H 51/02; B65H 54/50

[52] U.S. Cl. ..... 242/158.3; 242/35.5 R; 242/43 R; 242/157.1; 242/158.5

[58] Field of Search ..... 242/35.5 R, 43 R, 242/158.3, 157.1, 158.5

[56] References Cited

U.S. PATENT DOCUMENTS

| | | | |
|---|---|---|---|
| 3,401,894 | 9/1968 | Campbell, Jr. | 242/43 |
| 3,612,428 | 10/1971 | Hohle-Halske | 242/43 R X |
| 4,025,003 | 5/1977 | Kawauchi et al. | 242/158.3 X |
| 4,116,396 | 9/1978 | Fluck | 242/43 R |
| 4,230,285 | 10/1980 | Lenk et al. | 242/158.3 X |
| 4,365,765 | 12/1982 | Schneeberger et al. | 424/43 R |
| 4,685,637 | 8/1987 | Stitz | 242/43 R X |
| 5,048,769 | 9/1991 | Wirz et al. | 242/43 R |

FOREIGN PATENT DOCUMENTS

| | | |
|---|---|---|
| 18 63 134 U1 | 6/1961 | Germany . |
| 28 03 377 A1 | 8/1978 | Germany . |
| 37 34 481 A1 | 6/1989 | Germany . |
| 38 01 980 C2 | 5/1995 | Germany . |
| PS 275 388 | 8/1951 | Switzerland . |

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A traverse mechanism for a cheese producing textile machine includes a traverse housing having a longitudinal slit formed therein, a drive drum rotatably disposed within the housing, two yarn guides respectively disposed to move along the slit adjacent one another, with one of the yarn guides having a shuttle element disposed within the housing in driven connection with the drum, and a compound sealing slit covering element extending between and connecting two adjacent yarn guides for coupling the two yarn guides to be moved in unison upon driving of the shuttle element by the drum, the compound sealing slit covering element thereby also covering the slit to prevent dust and debris from entering the housing.

5 Claims, 2 Drawing Sheets

TRAVERSE MECHANISM FOR YARN GUIDES OF A WINDING DEVICE

FIELD OF THE INVENTION

The present invention relates to a reversing traverse mechanism for driving yarn guides of winding devices in textile machines of the type having multiple winding stations for the simultaneous winding of textile cheeses. More particularly, the present invention relates to such a traverse mechanism wherein a traverse housing rotatably supports a cylindrical traverse drive drum formed with an endless helical groove, with the yarn guide having a shuttle element which projects through a slit in the traverse housing to be guided in the helical groove, and wherein a sealing slit covering element connected with the respective yarn guide is associated with the slit as a slit seal.

BACKGROUND OF THE INVENTION

Traversing yarn guide drive mechanisms are used in textile machines when winding cheeses. In accordance with German Patent Publication DE 38 01 980 C1, each winding device of the cheese producing textile machine has a yarn guide, which is driven by the helically grooved drum to traverse back and forth along the cheese being wound. In most cases, the helically grooved drum is lubricated by means of oil or grease. For this reason, the drum is enclosed in traverse housing. The housing has a slit, through which a shuttle element of the yarn guide projects into the endless helical groove of the drum.

In accordance with the above mentioned German Patent Publication, the yarn guide slit of the traverse housing is sealed with the aid of a cover element in the form of a sealing slit covering element connected with the yarn guide. The seal prevents oil or grease from coming out through the slit, and likewise prevents textile dust from entering the slit. Because the seal is fixedly connected with the yarn guide, the slit in the traverse housing of this known device remains continuously sealed in spite of the traversing movement of the yarn guide.

However, an essential disadvantage of this known mechanism lies in that it is necessary to provide a separate traverse drive mechanism for each yarn guide. The corresponding expense for production and maintenance is considerable.

Swiss Patent Publication 275 388 proposes an alternate form of traverse drive for yarn guides for winding cheeses. In this case, two or more yarn guides are seated on a common guide carriage. The traversing movement of the guide carriage required for winding is provided by one helically grooved drum. Individual yarn guides are fastened on a cross bar which, in turn, is connected with the guide carriage. In this manner, it is possible to save traverse drives. However, the machine can only run comparatively slowly, since the single grooved drum must move not only additional yarn guides, but also the cross arm connecting the yarn guides. Thus, the large inert mass of these components rules out the employment of this known arrangement in modern, high-speed winding arrangements such as are used in connection with cheese producing textile machines.

OBJECT AND SUMMARY OF THE INVENTION

It is accordingly an object of the present invention, based on the above mentioned known devices, to provide an improved traverse drive mechanism for the winding devices of such textile machines.

This object is attained in accordance with the present invention by providing an improved reversing traverse mechanism adapted to control traversing reciprocation of at least two winding stations in a cheese producing textile machine for simultaneously winding a corresponding number of textile cheeses. According to the present invention, the traverse mechanism basically comprises a traverse housing having a longitudinal slit formed therein, a helically grooved drum rotatably enclosed in the housing, at least two yarn guides respectively disposed to move along the slit adjacent one another, one of the yarn guides having a shuttle element disposed within the housing in driven connection with the drum, and a compound sealing slit covering element disposed within the slit as a slit seal. The compound sealing slit covering element extends between and is connected with the two adjacent yarn guides for coupling the two adjacent yarn guides together to be moved in unison upon driving of the shuttle element by the drum.

Thus, in accordance with the invention, the sealing slit covering element or elements of adjoining yarn guides are fixedly connected with each other and a single traverse mechanism is provided for the compound sealing slit covering element thusly created. In this manner, the sealing slit covering elements fixedly joined, which elements are required in any event for covering the slits of the traverse housing, is used for the two-fold purpose in accordance with the present invention to perform both as a seal of traverse housing and as a force transmission means for driving the yarn guides.

The total mass which must be moved when the yarn guides are activated remains practically unchanged under the present invention in comparison with the known device of the above-mentioned German Patent Publication. The mass of the compound yarn guide created in accordance with the invention which must be moved back and forth by the grooved drum can even be slightly less than the total mass of the yarn guides formerly moved individually since each compound yarn guide only requires a single drive element engaging the groove of the drum. Since the sealing slit covering elements inside of each compound yarn guide are not interrupted, it is assured that the slit to be covered inside the compound area is not open at any location or time.

Preferably, the traverse housing has a longitudinal groove bordering the slit and the compound sealing slit covering element is guided in the groove. Advantageously, the compound sealing slit covering element may be made of a polyplastic material. In some embodiments, at least three adjoining yarn guides may be fixedly connected as a unit by the compound sealing slit covering element and a single shuttle element may be associated with the three yarn guides and driven by a single grooved drum.

Details of the invention will be explained by means of the schematic representation of an exemplary embodiment.

DETAILED DESCRIPTION OF THE PREFERRED EMBODIMENT

Figure 1:
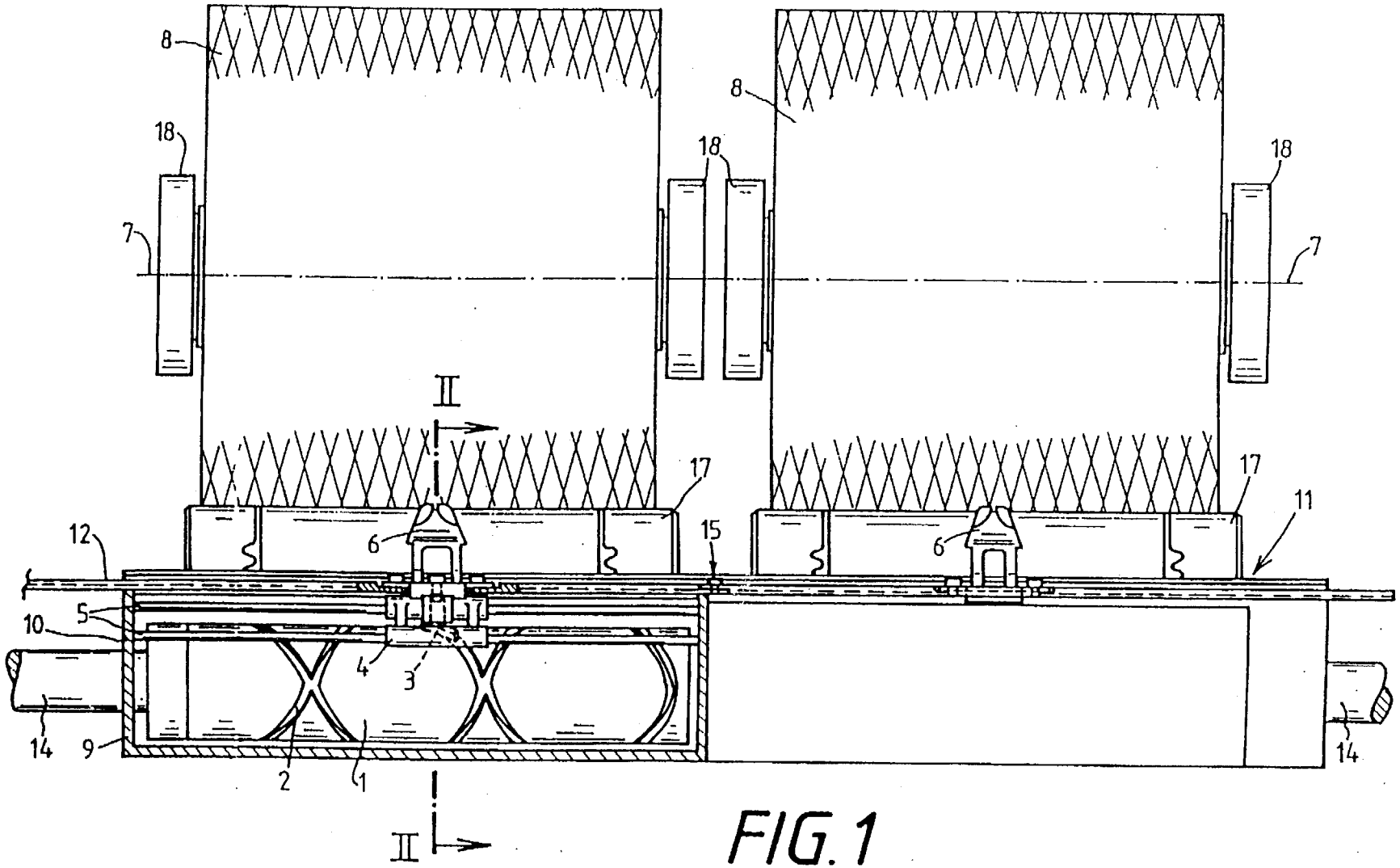
FIG. 1 is an elevational view of a traverse drive mechanism in accordance with the present invention, shown with two representative yarn guides connected by means of a compound sealing slit covering element.
Figure 2:
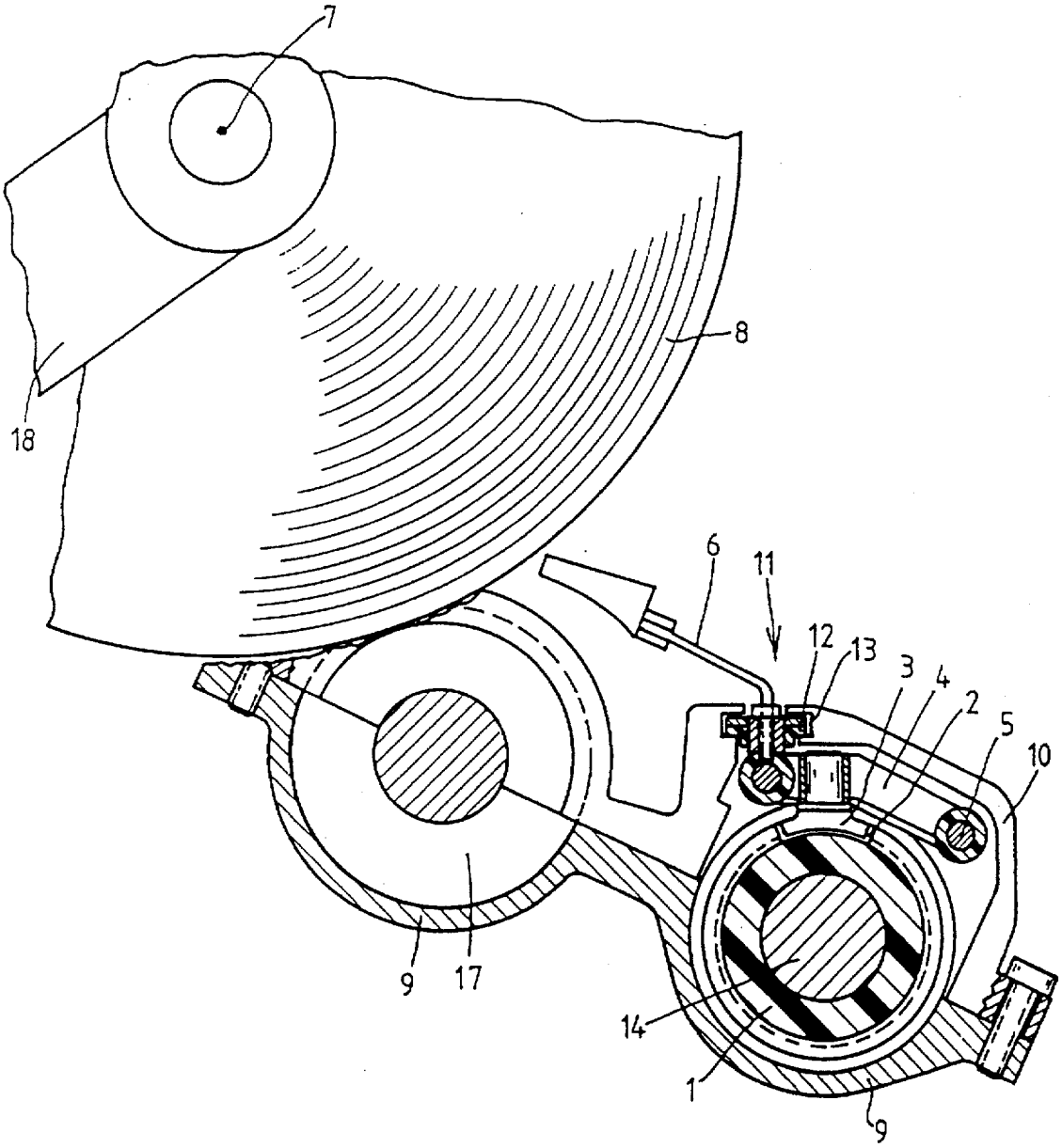
FIG. 2 is a transverse cross section of the traverse drive mechanism of FIG. 1 taken along the line II-II thereof.

The traverse drive mechanism schematically represented in FIGS. 1 and 2 comprises a rotatably driven spindle or drum 1, which is provided with a circumferential reversing groove 2 of an endless helical configuration. A shuttle element 3 is guided in the groove 2, which converts the rotating movement of the drum 1 into a linear movement via a sliding block 4. The sliding block 4 is seated on two guide rods 5 and is given a traversing movement by means of the shuttle 3 in a direction parallel with the winding axis 7 of a cheese 8 which is held in a winding frame 18 and surface driven by a rotatably driven drum 17. Since the yarn guide 6 is connected to the sliding block 4, the yarn guide 6 is also subjected to a corresponding traversing movement.

The grooved drum 1 is enclosed in a two-part housing 9, 10. A slit 11 is formed in the upper housing component 10, through which the yarn guide 6 extends to be connected with the sliding block 4. In turn, the sliding block 4 is connected with the shuttle 3 disposed in the groove 2 of the drum. The slit 11 is covered on both ends of the yarn guide 6 by a sealing slit covering element 12. Together with the yarn guide 6, the sealing slit covering element 12 moves back and forth in a groove 13 formed in the upper housing component 10 alongside the slit 11 when the grooved drum 1 is rotated by means of its drive shaft 14.

The sealing slit covering element 12 is fixedly connected with the associated yarn guide 6, so that the yarn guide 6 and the sealing slit covering element 12 move synchronously as a unit. In general, the sealing slit covering element 12 is made longer than the length of the slit 11 which is continuously covered by it, so that the slit 11 is completely covered in every position of the sealing slit covering element 12.

In accordance with the invention, the sealing slit covering elements 12 of at least two adjoining yarn guides 6 are fixedly connected with each other. In this case, the sealing slit covering elements of the yarn guides can be connected by means of an adhesive, a welding or a screw connection 15. However, in a preferred embodiment, it is provided to make the compound sealing slit covering elements of one piece. At least two adjoining yarn guides 6 are driven via the compound sealing slit covering element connected in this way, or the compound sealing slit covering element, with the aid of a single common helically grooved drum.

The number of the yarn guides to be driven by the one grooved drum 1 primarily depends on the mechanical properties of the system. In general, the number of connected yarn guides is determined by the mechanical stability of the shuttles 3 and the groove 2 and/or the size of the mass to be moved back and forth, as well as the mechanical stability of the sealing slit covering element 12. These parameters generally will limit the number of yarn guides 6 to be driven by a single grooved drum 1 to a few yarn guides (for example three). But even if one of the expensive grooved drums were to be associated with only every two yarn guides, this would still result in a large advantage by cutting the costs related to the traverse drive mechanisms in half.

While known sealing slit covering elements, which have the exclusive job of covering the slit 11 of the traverse housing, can be made of a foil material which is guided in the groove 13, the sealing slit covering element 12 in accordance with the present invention, which is additionally to be used for driving at least one extra yarn guide 6, should be made of a material with an appropriate inherent stability and tensile strength, so that no undefined extensions or compressions are created when driving an adjoining yarn guide 6. A polyplastic material, for example, could be used as a suitable material.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A traverse mechanism for a cheese producing textile machine having at least two winding stations for the simultaneous winding of a corresponding number of textile cheeses, the traverse mechanism comprising a traverse housing having a longitudinal slit formed therein, a drive drum rotatably enclosed in the housing, at least two yarn guides respectively disposed to move along the slit adjacent one another, one of the yarn guides having a shuttle element disposed within the housing in driven connection with the drum, and a compound sealing slit covering element disposed within the slit as a slit seal, the compound sealing slit covering element extending between and being connected with the two adjacent yarn guides for coupling the two adjacent yarn guides to be moved in unison upon driving of the shuttle element by the drum.

2. The traverse mechanism in accordance with claim 1, wherein at least three adjoining yarn guides are fixedly connected as a unit by the compound sealing slit covering element and a single shuttle element is associated with the three yarn guides and driven by a single drum.

3. The traverse mechanism in accordance with claim 2, wherein the traverse housing has a groove bordering the slit and the compound sealing slit covering element is guided in the groove.

4. The traverse mechanism in accordance with claim 1, wherein the compound sealing slit covering element is made of a polyplastic material.

5. The traverse mechanism in accordance with claim 1, wherein the compound sealing slit covering element is longer than the length of the slit whereby the compound sealing slit covering element continuously covers the slit in every position of the compound sealing slit covering element.

* * * * *